US006825606B2

(12) United States Patent
Schermerhorn et al.

(10) Patent No.: US 6,825,606 B2
(45) Date of Patent: Nov. 30, 2004

(54) FLAT PLASMA DISPLAY PANEL WITH INDEPENDENT TRIGGER AND CONTROLLED SUSTAINING ELECTRODES

(75) Inventors: Jerry D. Schermerhorn, Perrysburg, OH (US); Oleksandr Shvydky, Toledo, OH (US)

(73) Assignee: LG Electronics Inc., Seoul (KR)

( * ) Notice: Subject to any disclaimer, the term of this patent is extended or adjusted under 35 U.S.C. 154(b) by 271 days.

(21) Appl. No.: 09/915,721

(22) Filed: Jul. 26, 2001

(65) Prior Publication Data

US 2002/0011800 A1 Jan. 31, 2002

Related U.S. Application Data

(63) Continuation-in-part of application No. 09/629,118, filed on Jul. 31, 2000, now Pat. No. 6,597,120, which is a continuation-in-part of application No. 09/376,130, filed on Aug. 17, 1999, now Pat. No. 6,459,201.

(51) Int. Cl.[7] ..... H01J 63/02; H01J 63/08; G09G 3/10

(52) U.S. Cl. ..... 313/484; 313/491; 313/494; 313/581; 313/585; 313/586; 315/169.4

(58) Field of Search ..... 313/484, 485, 313/491, 494, 245, 250, 257, 258, 262, 268, 288, 289, 292, 498, 581, 582, 583, 584, 585, 586, 587, 592, 602, 603, 610, 611, 612; 315/169.1, 169.2, 169.3, 169.4; 345/60, 68

(56) References Cited

U.S. PATENT DOCUMENTS

| | | | |
|---|---|---|---|
| 3,499,167 | A | 3/1970 | Baker et al. |
| 3,559,190 | A | 1/1971 | Bitzer et al. |
| 3,755,027 | A | 8/1973 | Gilsing |
| 3,925,703 | A | 12/1975 | Schermerhorn |
| 3,942,061 | A | 3/1976 | van Esdonk et al. |
| 3,946,381 | A | 3/1976 | Johnson et al. |
| 4,180,762 | A | 12/1979 | Weber |
| 4,198,585 | A | 4/1980 | Yamashita et al. |
| 4,494,038 | A | 1/1985 | Wedding et al. |
| 4,550,274 | A | 10/1985 | Weber |
| 4,574,280 | A | 3/1986 | Weber |
| 4,629,942 | A | 12/1986 | Horio et al. |
| 4,638,218 | A | 1/1987 | Shinoda et al. |
| 4,723,093 | A | 2/1988 | Nolan |
| 4,737,687 | A | 4/1988 | Shinoda et al. |
| 4,772,884 | A | 9/1988 | Weber et al. |
| 4,866,349 | A | 9/1989 | Weber et al. |

(List continued on next page.)

FOREIGN PATENT DOCUMENTS

| | | |
|---|---|---|
| JP | 55-179962 | 6/1982 |
| JP | 58-153545 | 3/1985 |
| JP | 2671870 | 7/1997 |
| JP | 10-333636 | 12/1998 |
| JP | 10-038688 | 8/1999 |
| JP | 10-069949 | 10/1999 |

*Primary Examiner*—Nimeshkumar D. Patel
*Assistant Examiner*—Sharlene Leurig
(74) *Attorney, Agent, or Firm*—MacMillan, Sobanski & Todd, LLC

(57) ABSTRACT

A plasma flat-panel display has a glass substrate having a first pair of parallel sustainer electrodes deposited thereon that includes a first sustainer electrode and a second sustainer electrode. A second pair of parallel sustainer electrodes also is deposited upon the substrate that also includes a first sustainer electrode and a second sustainer electrode. A single common electrode pad is electrically connected to the first sustainer electrode in the first sustainer electrode pair and the first sustainer electrode in the second sustainer electrode pair. The electrode pad is adapted to be connected to a first sustainer voltage waveform supply so that a single supply provides a voltage waveform to both of the first sustainer electrodes.

19 Claims, 14 Drawing Sheets

U.S. PATENT DOCUMENTS 4,924,218 A 5/1990 Weber et al.
5,081,400 A 1/1992 Weber et al.
5,086,297 A 2/1992 Miyake et al.
5,144,200 A 9/1992 Kim
5,164,633 A 11/1992 Kim et al.
5,247,288 A 9/1993 Warren et al.
5,250,936 A 10/1993 Warren et al.
5,430,458 A 7/1995 Weber
5,525,862 A 6/1996 Miyazaki
5,541,479 A 7/1996 Nagakubo
5,634,836 A 6/1997 Lepselter
5,661,500 A 8/1997 Shinoda et al.
5,674,553 A 10/1997 Shinoda et al.
5,723,945 A 3/1998 Schermerhorn
5,745,086 A 4/1998 Weber
5,757,131 A 5/1998 Tsuchiya
5,962,983 A 10/1999 Anderson et al.
5,990,854 A 11/1999 Weber
6,031,329 A 2/2000 Nagano
6,288,692 B1 * 9/2001 Kanazawa et al. ..... 315/169.4

* cited by examiner

FLAT PLASMA DISPLAY PANEL WITH INDEPENDENT TRIGGER AND CONTROLLED SUSTAINING ELECTRODES

CROSS REFERENCE TO RELATED APPLICATIONS

This application is a Continuation-in-Part of U.S. patent application Ser. No. 09/629,118, filed Jul. 31, 2000, now U.S. Pat. No. 6,597,120, which is, in turn, a Continuation-in Part of U.S. patent application Ser. No. 09/376,130, filed Aug. 17, 1999, now U.S. Pat. No. 6,459,201.

FIELD OF INVENTION

This invention relates in general to a flat plasma display panel and in particular to an improved structure for a full color, high resolution capable flat plasma display panel which operates at a high efficiency and includes independent trigger and controlled sustaining electrodes.

BACKGROUND OF THE INVENTION

A flat plasma display panel is an electronic display in which a large orthogonal array of display pixels, such as electro-luminescent devices, AC plasma display panels, DC plasma display panels and field emission displays and the like form a flat screen.

The basic structure of an AC Plasma Display Panel, or PDP, comprises two glass plates with a conductor pattern of electrodes on the inner surfaces of each plate. The plates are separated by a gas filled gap. The electrodes are configured in an x-y matrix with the electrodes on each plate deposited at right angles to each other using conventional thin or thick film techniques. At least one set of sustaining electrodes of the AC PDP is covered with a thin glass dielectric layer. The glass plates are assembled into a sandwich with the gap between the plates fixed by spacers. The edges of the plates are sealed and the cavity between the plates is evacuated and filled with a mixture of neon and xenon gases or a similar gas mixture of a type well known in the art.

During operation of an AC PDP, a sufficient driver voltage pulse is applied to the electrodes to ionize the gas contained between the plates. When the gas ionizes, the dielectrics charge like small capacitors, which reduces the voltage across the gas and extinguishes the discharge. The capacitive voltages are due to stored charge and are conventionally called wall charge. The voltage is then reversed, and the sum of the driver voltage and wall charge voltages is again large enough to excite the gas and produce a glow discharge pulse. A sequence of such driver voltages repetitively applied is called the sustaining voltage, or sustainer. With the sustainer waveform, pixels which have had charge stored will discharge and emit light pulses at every sustainer cycle. Pixels which have no charge stored will not emit light. As appropriate waveforms are applied across the x-y matrix of electrodes, small light emitting pixels form a visual picture.

Typically, layers of red, green or blue phosphor are alternately deposited upon the inner surface of one of the plates. The ionized gas causes the phosphor to emit a colored light from each pixel. Barrier ribs are typically disposed between the plates to prevent cross-color and cross-pixel interference between the electrodes. The barrier ribs also increase the resolution to provide a sharply defined picture. The barrier ribs further provide a uniform discharge space between the glass plates by utilizing the barrier rib height, width and pattern gap to achieve a desired pixel pitch.

Further details of the structure and operation of an AC PDP are disclosed in U.S. Pat. No. 5,723,945 titled "FLAT PANEL DISPLAY"; U.S. Pat. No. 5,962,983, entitled "METHOD OF OPERATION OF DISPLAY PANEL"; and U.S. patent application Ser. No. 09/259,940, filed Mar. 1, 1999, entitled "FLAT-PANEL DISPLAY", all of which are incorporated herein by reference.

SUMMARY OF THE INVENTION

This invention relates to an improved plasma flat plasma display panel which operates at a high efficiency and includes independent trigger and controlled sustaining electrodes.

It is known to manufacture plasma flat plasma display panels having pairs of sustaining electrodes which establish a charged volume between the display substrates. The charge supports a plasma discharge that is controlled by applying voltages to a plurality of address electrodes. The charged volume is established by applying an initial voltage to the sustaining electrodes. The actual plasma discharge is initiated between the sustaining electrodes by applying a second sustaining voltage to the sustaining electrodes. The efficiency of the panel is generally greater when gas and geometry parameters are adjusted to increase the voltage required to sustain a discharge. However, this causes complexity for the associated voltage supply circuits with respect to the initiating voltage. Therefore, it would be desirable to develop a plasma display panel that would allow initiation and control of the sustaining discharge with a relatively low voltage while sustaining the resulting plasma discharge with a relatively high voltage.

It is also known to provide each of the electrodes in a plasma display panel with a separate voltage driver. The total number of voltage drivers and their physical connections to the panel electrodes add considerable bulk and cost to the final display panel. Accordingly, it also would be desirable to reduce the number of separate voltage drivers.

The present invention contemplates a plasma flat-panel display having a first transparent substrate with a first pair of parallel sustainer electrodes deposited upon thereon. The first pair of sustainer electrodes include a first sustainer electrode and a second sustainer electrode. The display also includes at least one auxiliary electrode deposited upon the first substrate parallel to the first pair of sustainer electrodes and adjacent to the first sustainer electrode in the first pair of sustainer electrodes. A second pair of parallel sustainer electrodes is deposited upon the first substrate parallel to the auxiliary electrode, the second pair of sustainer electrodes including a first sustainer electrode and a second sustainer electrode. The second sustainer electrode pair is oriented upon the first substrate as a mirror image of the first sustainer electrode pair with the first sustainer electrode in the second pair of sustainer electrodes adjacent to the auxiliary electrode. A single common first sustainer electrode pad is electrically connected to the first sustainer electrode in the first sustainer electrode pair and the first sustainer electrode in the second sustainer electrode pair. The first sustainer electrode pad is adapted be to connected to a first sustainer voltage waveform supply so that a single supply provides a first sustainer voltage waveform to both of the first sustainer electrodes. A layer of dielectric material covers the sustainer and auxiliary electrodes. A protection layer is formed covering the dielectric layer. The display further includes a second substrate which is hermetically sealed to the first substrate with the second substrate having a plurality of micro-voids formed in a surface thereof that is adjacent to the first substrate. The micro-voids are filled with a gas and cooperate with the first substrate to define a plurality of sub-pixels. A phosphor material is deposited within each micro-void and a plurality of address electrodes are incorporated within said second substrate. Each of the address electrodes correspond to one of the sub-pixels.

The present invention also contemplates a method for operating a plasma flat-panel display that includes applying in a set-up period first and second sustain, auxiliary, and address voltage waveforms to corresponding electrodes. Similar electrodes are connected by pads to cause the setting of all wall charge on associated dielectric surfaces corresponding to the controlled discharge volumes of sub-cells to values appropriate to an "off" state. A first auxiliary voltage waveform is then applied in an addressing period in conjunction with an address voltage waveform sequentially for each auxiliary voltage waveform supply connected by pads to corresponding first auxiliary electrodes. The first auxiliary voltage waveform selectively initiates discharges between associated first and second sustain electrode pairs, thereby setting the wall charge on the dielectric surfaces associated with the sustainer electrodes corresponding to the controlled discharge volumes of selected sub-cells to values appropriate to an "on" state. Subsequently, a pre-determined number of voltage pulses via first and second sustain waveform supplies are applied during a sustaining period to create a pre-determined number of discharges in a sequence corresponding to the voltage pulses in cells set to an "on" state with the discharges controlled in position and shape by auxiliary voltage waveform supplies.

Various objects and advantages of this invention will become apparent to those skilled in the art from the following detailed description of the preferred embodiment, when read in light of the accompanying drawings.

DETAILED DESCRIPTION OF THE PREFERRED EMBODIMENTS

Figure 1:
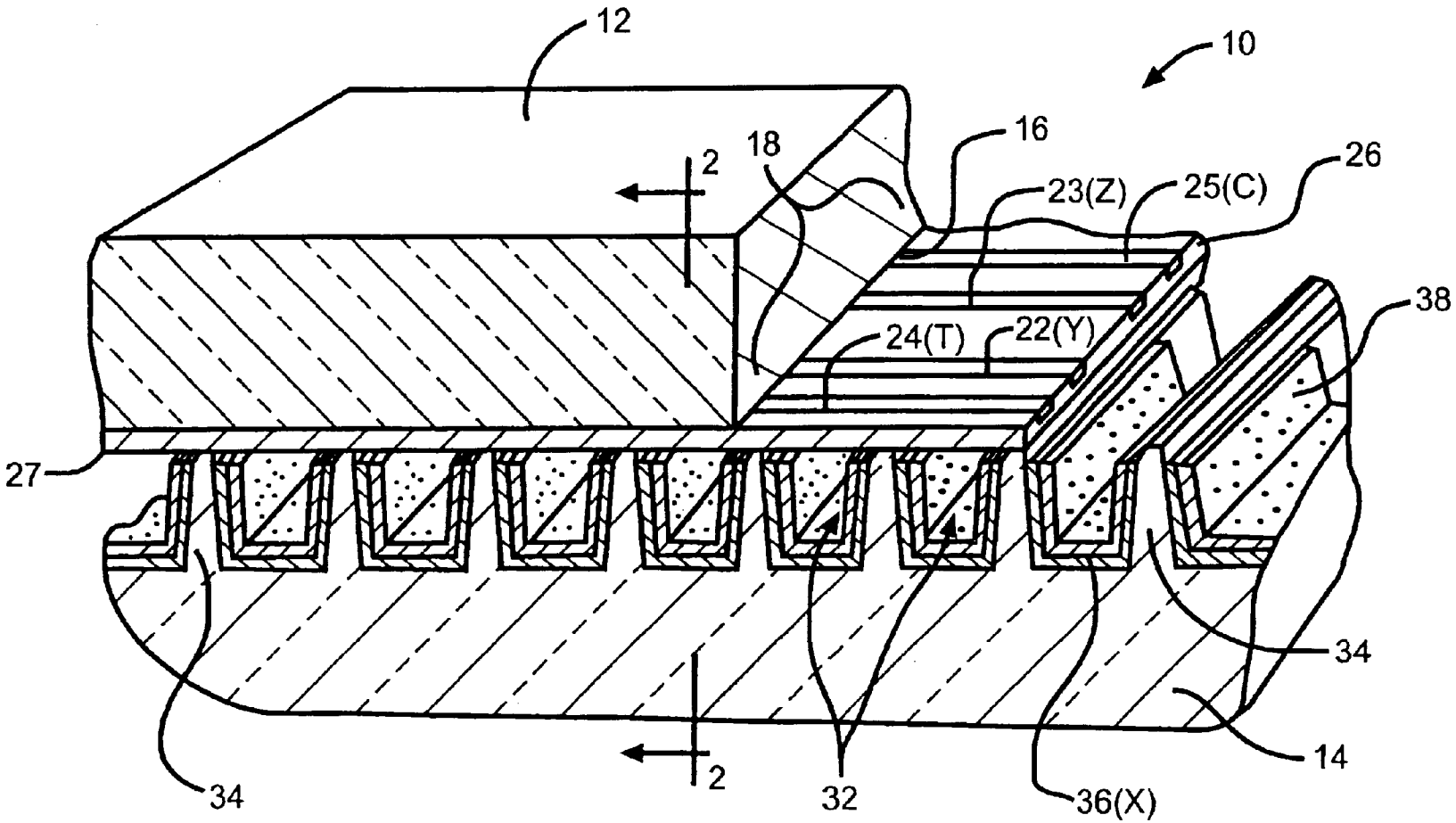
FIG. 1 is a perspective view of a plasma display panel.
Figure 2:
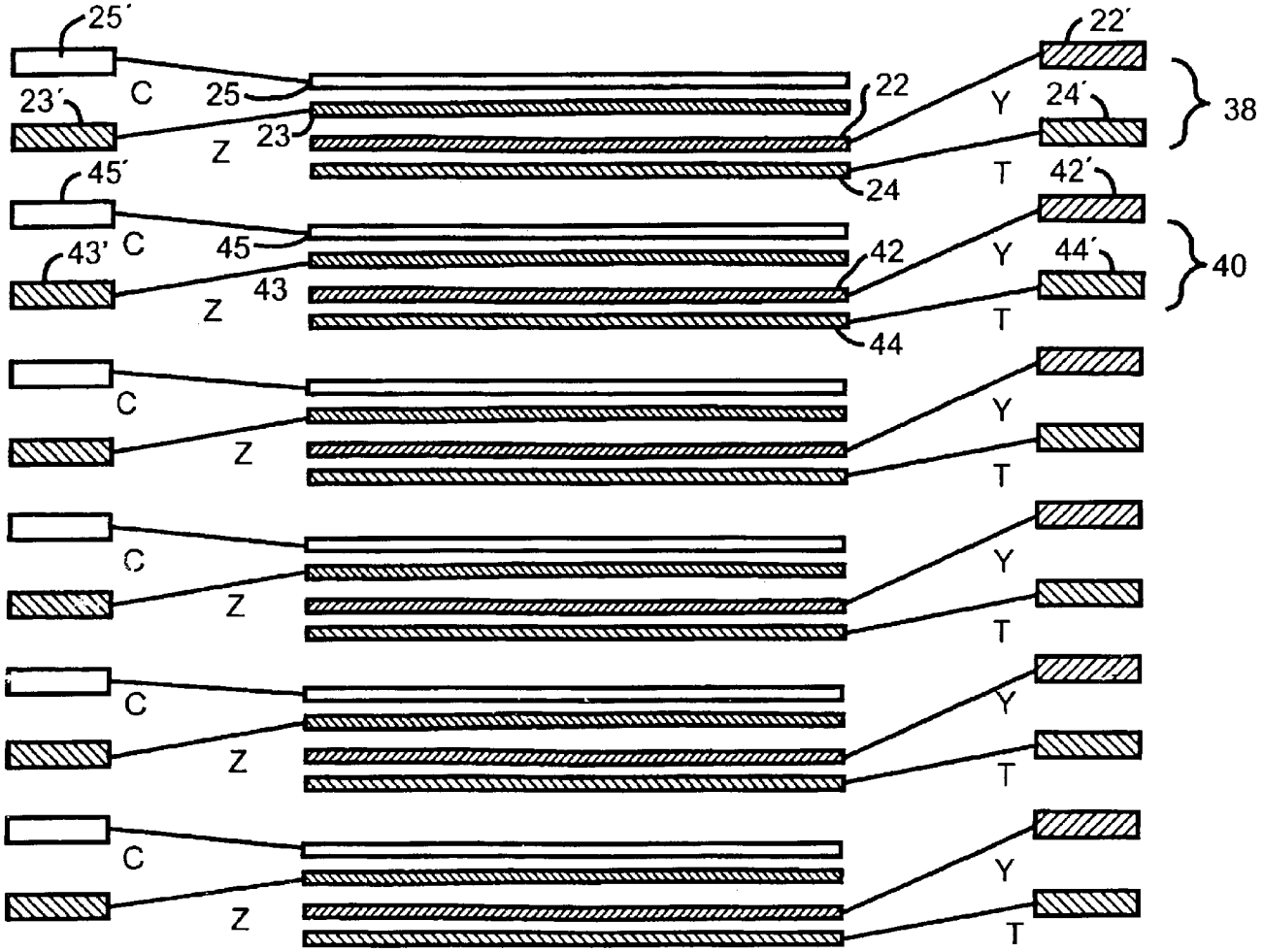
FIG. 2 is a plan view of an arrangement of the electrodes included in the plasma display panel shown in FIG. 1.

Referring now to the drawings, there is illustrated in FIGS. 1 and 2 the structure of a plasma display panel (PDP) 10, which, in the preferred embodiment, is an AC PDP. In the following description, like reference characters designate like or corresponding parts. Also, in the following description, it is to understood that such terms as "top", "bottom", "forward", "rearward", and similar terms of position and direction are used in reference to the drawings and for convenience in description.

Generally, the PDP 10 comprises a hermetically sealed gas filled enclosure including a top glass substrate 12 and a spaced apart bottom glass substrate 14. The top glass substrate 12 is superposed upon the bottom glass substrate 14. The glass substrates 12 and 14 are typically both transmissive to light and of a uniform thickness, although only the viewing side, normally the top substrate 12, is required to be transparent to visible light. For example, the glass substrates 12 and 14 may be approximately ⅛ to ¼ inch thick.

The top glass substrate 12 may contain $SiO_2$, $Al_2O_3$, $MgO_2$ and CaO as the main ingredients and $Na_2O$, $K_2O$, PbO, $B_2O_3$ and the like as accessory ingredients. Deposited upon a lower surface 16 of the top substrate 12 are a plurality of sets of parallel electrodes. One such set, which is labeled 18, is illustrated in FIG. 1. Each set of electrodes includes an inner pair of display, or sustainer, electrodes 22 and 23, which typically have a spacing of approximately 800 microns. The sustainer electrode 22 that is in the foreground in FIG. 1 is referred to as the first sustainer electrode and also labeled Y in the following while the other sustainer electrode 23 is referred to as the second sustainer electrode and also labeled Z in the following. Disposed adjacent and parallel to the first sustainer electrode 22 is a trigger electrode 24 that also is labeled T in the following. Similarly, a control electrode 25, that is also labeled C in the following, is disposed adjacent and parallel to the second sustainer electrode 23. As best seen in FIG. 2, the sustainer electrodes 22 and 23 are between the trigger electrode 24 and the control electrode 25. The trigger and control electrodes 24 and 25 typically have a spacing from the corresponding sustainer electrode, 22 and 23, within the range of 100 microns to 400 microns. The electrodes 22, 23, 24 and 25 are formed by a conventional process. In the preferred embodiment, the electrodes 22, 23, 24 and 25 are thin film electrodes prepared from evaporated metals such as Au, Cr and Au, Cu and Au, Cu and Cr, ITO and Au, Ag, or Cr and the like.

A uniform charge storage film 26 such as a dielectric film of a type well known in the art covers the electrodes 22, 23, 24 and 25 by a variety of planar techniques well known in the art of display manufacture. The charge storage film 26 may be of most any suitable material, such as a lead glass material. In the preferred embodiment, the charge storage film 26 is covered by a thin electron emissive layer 27 The electron emissive layer 27 may be formed from most any suitable material, such as diamond overcoating, MgO, or the like. As will be explained below, the electron emissive layer 27 may be uniform or patterned.

As shown in FIG. 1, a plurality of parallel microgrooves 32 are formed into the upper surface of the bottom substrate 14. The microgrooves 32 are generally perpendicular to the electrodes 22, 23, 24 and 25 deposited upon the top substrate 12. The microgrooves 32 are separated by barrier ribs 34 which extend in an upward direction in FIG. 1. The upper end of each of the barrier ribs 34 contacts the electron emissive layer 27 that is deposited upon the lower surface 16 of the top substrate 12. Alternately, the microgrooves 32 and barrier ribs 34 can be formed into an intermediate glass layer which is disposed between the top and bottom substrates 12 and 14. (not shown). Whichever process is utilized, the microgrooves 32 and barrier ribs 34 are preferably formed from an etchable glass material which is inherently selectively crystallizing, such as, a glass-ceramic composite doped with suitable nucleating agents.

Address electrodes 36, that are also labeled X in the following are deposited within each microgroove 32. The address electrodes 36 are deposited along the base and surrounding sidewalls of the microgrooves 32 to increase uniformity of firing and provide optimum phosphor coating along the entire surface of the microgroove 32. The address electrodes 36 are deposited by selectively metalizing a thin layer of Cr and Au or Cu and Au, or Indium Tin Oxide (ITO) and Au, or Cu and Cr, or Ag or Cr within the microgroove surfaces. The metalization may be accomplished by thin film deposition, E-beam deposition or electroless deposition and the like as well known in the art. Because the microgrooves 32 are generally perpendicular to the electrodes 22, 23, 24 and 25 deposited upon the top substrate 12, the address electrodes 36 cooperate with the sustaining electrode pairs 22 and 23 to define an orthogonal electrode matrix.

Instead of microgrooves, it will be appreciated that the invention also can be practiced utilizing micro-voids (not shown) formed by creating wells on the surface of the bottom substrate over and aligned with the electrodes 22, 23, 24 and 25. The non-voided surface areas form barrier ribs perpendicular to the electrodes 22, 23, 24 and 25 and divider ribs parallel to and separating the sustaining electrode pairs 22 and 23 and the trigger and control electrodes 24 and 25. Alternately, parallel barrier ribs can be formed on the surface of the bottom substrate over and aligned with address electrodes to form the micro-voids, as disclosed in U.S. patent application Ser. No. 09/259,940, which is referenced above.

A phosphor material 38 is deposited over at least a portion of each address electrode 36. In a preferred embodiment, the phosphor material 38 is deposited by electrophoresis as well known in the art. The phosphor material is of a type well known in the art and for a full color display red, green and blue phosphors are separately deposited in an alternating pattern to define individual pixels. The resolution of the PDP 10 is determined by the number of pixels per unit area.

The channels 32 are filled with a proportioned mixture of two or more gases that can be ionized. The gases produce sufficient UV radiation to excite the phosphor material 38. In the preferred embodiment, a gas mixture of neon and from about five to 20 percent by weight of xenon and helium is used.

An arrangement of the top substrate electrodes 22, 23, 24 and 25 is illustrated in FIG. 2. In FIG. 2, the electrodes 22, 23, 24 and 25 are shaded to illustrate the electrode pattern. The top four electrodes form a first group of electrodes that is labeled 38. The group 38 includes a control electrode 25 at the top of the figure. The control electrode 25 also can be referred to as an auxiliary electrode or a second auxiliary electrode. The control electrode 25 is connected to a control electrode pad 25' that is on the left side of FIG. 2. The pad 25' provides an electrical connection between the control electrode 25 and a control voltage driver, as will be described below. Proceeding in a downward direction from the control electrode 25 in FIG. 2, the next electrode in the first group 38 is a second sustainer electrode 23 that is connected to a second sustainer electrode pad 23' that also is on the left side of FIG. 2. The second sustainer electrode 23 also is labeled with a "Z". Continuing in a downward direction in FIG. 2, adjacent to the second sustainer electrode 23 is a first sustainer electrode 22 that is connected to a first sustainer electrode pad 22' on the right side of FIG. 2. The first sustainer electrode 22 also is labeled with the letter "Y". The bottom electrode in the first group 38 is a trigger electrode 24 which is connected to a trigger electrode pad 24' that also is on the right side of FIG. 2. The trigger electrode 24 also is labeled with the letter "T". The trigger electrode 24 also can be referred to as an auxiliary electrode or a first auxiliary electrode. Thus, the orientation of the electrodes in the first group 38 is the same as shown in FIG. 1.

The electrode orientation shown for the electrode group 38 repeats for the remaining groups of electrodes in FIG. 2. Thus, a second group of electrodes 40 immediately below the first group 38 has a control electrode 45 on top that is connected a control electrode pad 45' on the left side of FIG. 2. The second electrode from the top of the second group 40 is a second sustainer electrode 43 that is connected to a second sustainer electrode pad 43' on the left side of FIG. 2. The third electrode is a first sustainer electrode 42 that is connected to a first sustainer electrode pad 42' on the right, while the bottom electrode in the second group is a trigger electrode 44 connected to a trigger electrode pad 44', also on the right. The remaining electrodes in FIG. 2 are identified with the letters to show the pattern of electrodes. As seen by the letter labels of C, Z, Y, and T, the pattern repeats for each succeeding group of electrodes. Each of the individual electrode pads associated with the electrodes would be connected to a conventional plasma display panel voltage driver for selectively establishing plasma discharges within corresponding portions of the panel microgrooves 32.

Figure 3:
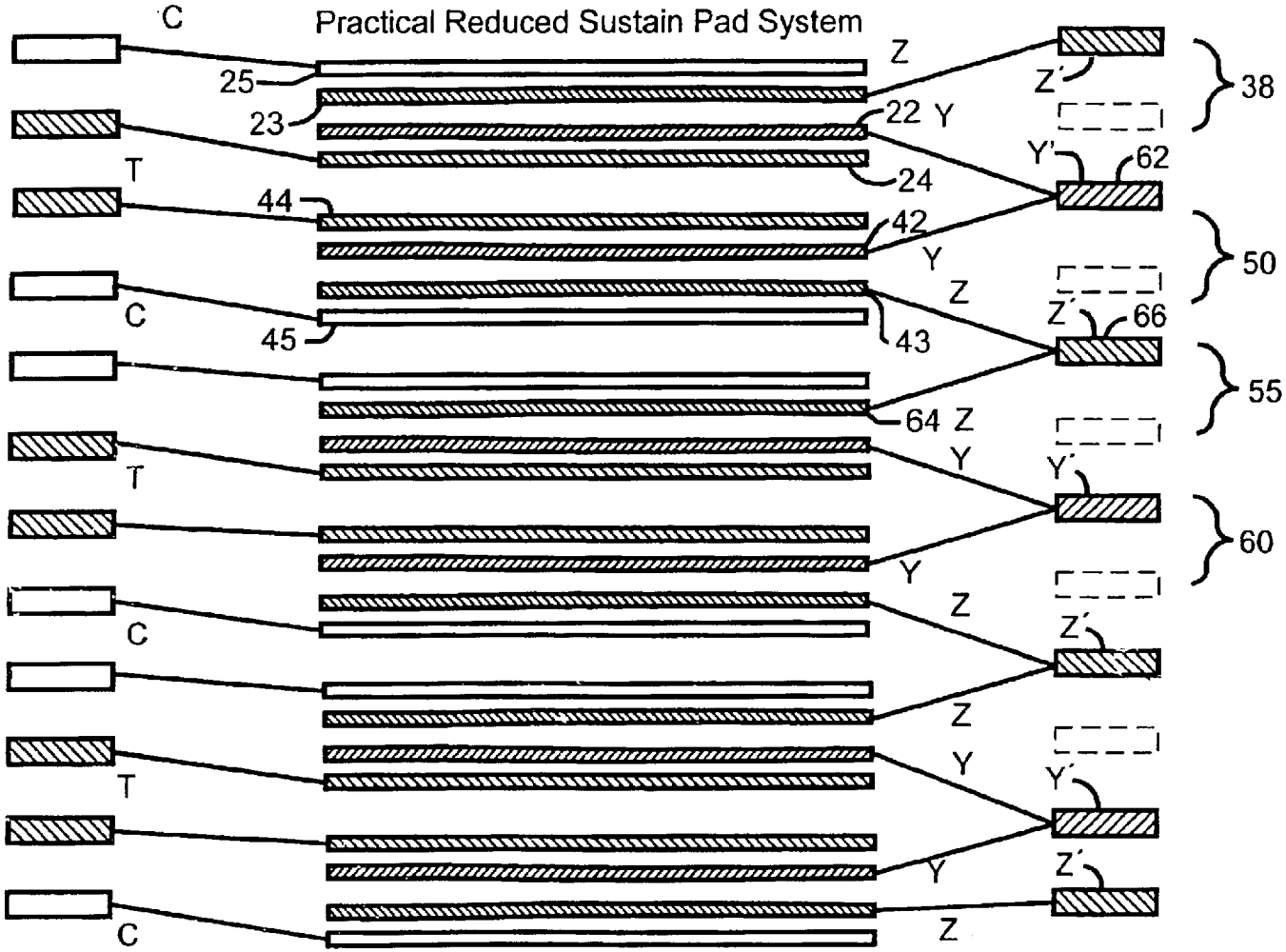
FIG. 3 is a plan view of an alternate arrangement of the electrodes included in the plasma display panel shown in FIG. 1.

The inventors contemplate an alternate arrangement of the electrodes in a plasma display panel, as illustrated in FIG. 3. The top group of electrodes in FIG. 3 is formed in the same order as the top group of electrodes shown in FIG. 2. Accordingly, the top group also is labeled 38 in FIG. 3 and the order of electrodes in a downward direction from the top is control electrode C, second sustainer electrode Z, first sustainer electrode Y and trigger electrode T. The second group of electrodes in FIG. 3 is labeled 50 and is formed upon the top substrate 12 as a mirror image of the first group 38. Thus, the top electrode in the second group 50 is a trigger electrode T and the second electrode from the top of the group 50 is a first sustainer electrode Y. Similarly, the third electrode is a second sustainer electrode Z while the bottom electrode in the group 50 is a control electrode C. Note that the electrode pads associated with the sustainer electrodes, Y and Z, are on the right side of FIG. 3 while the electrode pads associated with the control and trigger electrodes, C and T, are on the left side of FIG. 3. The alternation of the electrode patterns in each group alternates throughout the display panel 10. Accordingly, the third group of electrodes 55 has the same pattern as the first group 38 while the fourth group 60 repeats the pattern of the second group 50.

Because the sustainer electrodes, Y and Z, in each electrode group shown in FIG. 3 are reversed, pairs of first and second sustainer electrodes can be electrically connected to a common electrode pad. Thus, in FIG. 3, the first sustainer electrode 22 (Y) in the first electrode group 38 and the first sustainer electrode 42 (Y) in the second electrode group 50 are electrically connected to a common second sustainer electrode pad 62 (Y'). Similarly, the second sustainer electrode 43 (Z) in the second electrode group 50 and second sustaining electrode 64 (Z) in the third electrode group 55 are electrically connected to a common second sustainer electrode pad 66 (Z'). Upon comparison to the prior art arrangement of electrodes shown in FIG. 2, approximately half of the sustainer electrode pads on the right side of the panel 10 have been eliminated, as shown by the phantom pads in FIG. 3. Accordingly, the present invention permits a significant reduction in the number of electrical connections and associated driver circuitry from prior art display panels. Therefore, the present invention contemplates a significant reduction in the cost of fabrication a plasma display panel 10.

Figure 4:
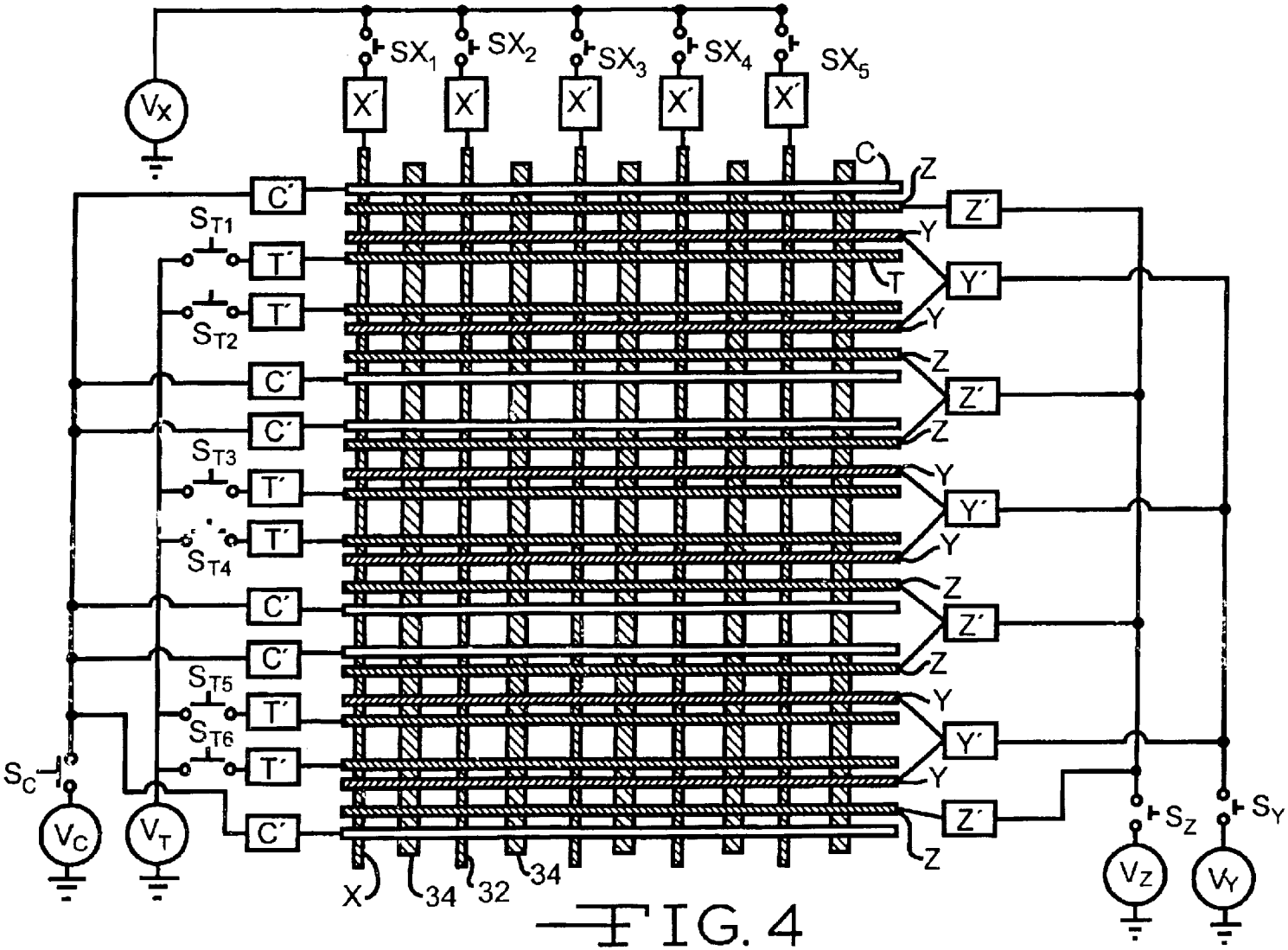
FIG. 4 is a plan view of the electrodes shown in FIG. 3 connected to voltage supplies.

The drivers associated with the electrodes are illustrated in the plan view of the panel 10 shown in FIG. 4. The drawing of the panel in FIG. 4 has been simplified for clarity. The pattern of top substrate electrodes shown in FIG. 3 is repeated in FIG. 4 with the addition of address electrodes 32 and barrier ribs 34 that are formed on the bottom substrate 14. As described above, the address electrodes 32 and barrier ribs 34 are generally perpendicular to the top substrate electrodes. As shown in FIG. 4, the address electrodes 32 are identified with the letter "X". Also shown in FIG. 4 is a schematic diagram of the electrode drivers. Six groups of bottom substrate electrodes and five address electrodes are shown in FIG. 4 and define a 6×5 array with 30 pixels. It will be appreciated that the circuitry shown in FIG. 4 can be also be applied to larger smaller arrays.

Each of the drivers consists of a voltage supply which is selectively connected to associated electrodes through conventional switches. Thus, as shown on the right side of FIG. 4, pairs of first sustainer electrodes Y are selectively connected through common electrode pads Y' and a conventional electronic switch labeled $S_Y$ to a first sustaining voltage supply labeled $V_Y$. The first sustaining voltage supply generates first sustaining voltage waveforms that are described below. To simplify the drawing, the logic circuitry for controlling the electronic switches has been omitted from FIG. 4. Similarly, pairs of second sustaining electrodes Z are selectively connected through common electrode pads Z' and a conventional electronic switch labeled $S_Z$ to a second sustaining voltage supply labeled $V_Z$. The second sustaining voltage supply $V_Z$ generates second sustaining voltage waveforms that also are described below. On the left side of FIG. 4, the trigger electrodes T are selectively connected through electrode pads T' and individual conventional electronic switches labeled $S_{T1}$ through $S_{T6}$ to a trigger voltage supply labeled $V_T$. The trigger voltage supply $V_T$ generates a trigger voltage waveform that is described below. The control electrodes C are selectively coupled through electrode pads C' and a conventional electronic switch labeled $S_C$ to a control voltage supply labeled $V_C$. Finally, the address electrodes X are selectively connected through conventional electronic switches labeled $S_{X1}$, through $S_{X5}$ to an address voltage supply that is labeled $V_X$. The address voltage supply $V_X$ generates address voltage waveforms that will be described below.

Because of the common sustainer electrode pads, Y' and Z', sustaining voltage waveforms are applied simultaneously to pairs of first and second sustainer electrodes Y and Z in adjacent electrode groups during operation of the plasma display panel 10. However, the selective application of trigger voltage waveforms to the trigger electrodes T controls the establishment of plasma discharges with the display panel 10.

Figure 5:
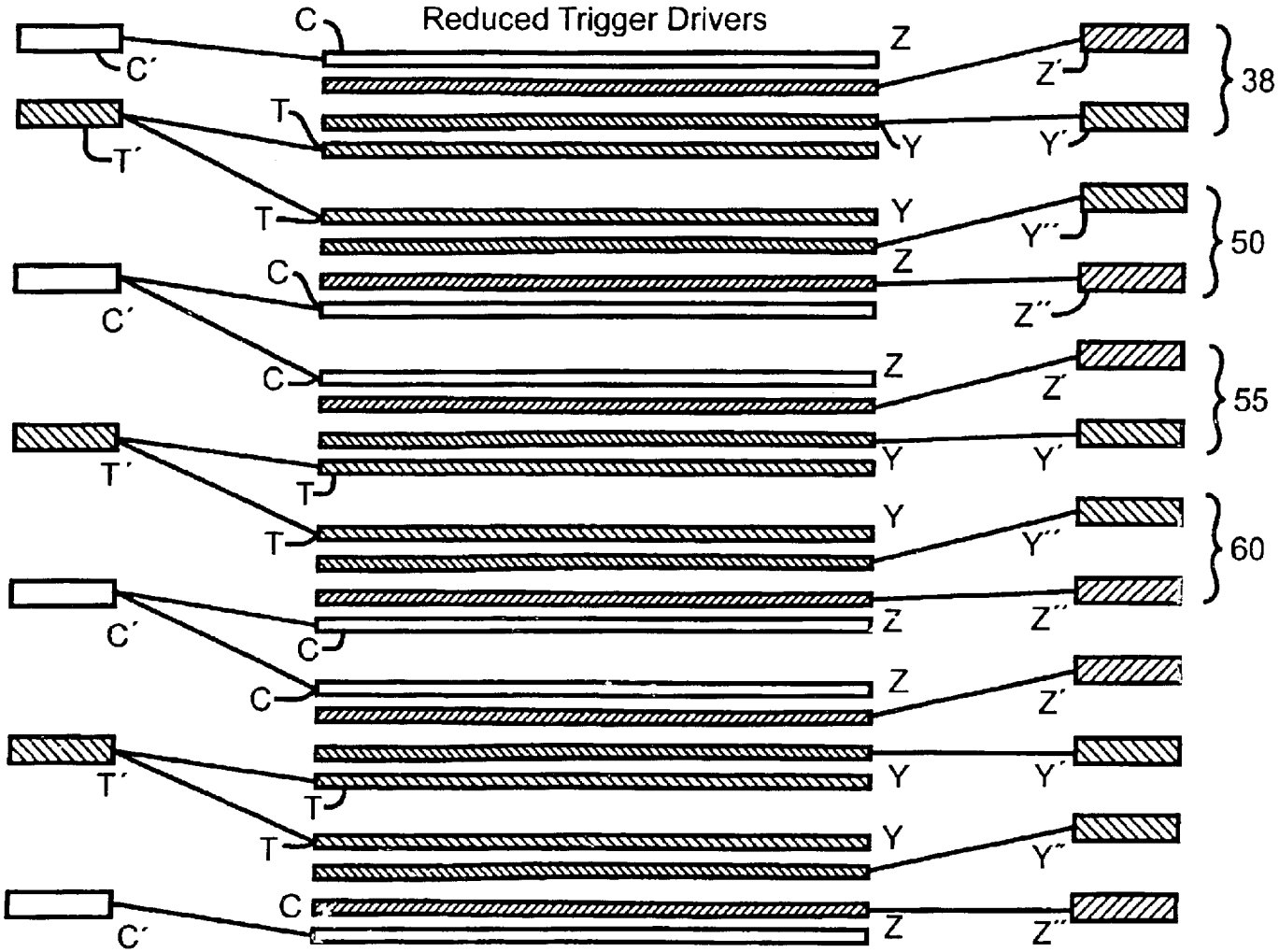
FIG. 5 is a plan view of another alternate arrangement of the electrodes included in the plasma display panel shown in FIG. 1.

An alternate embodiment of the invention is illustrated in FIG. 5, where components that are similar to components shown in FIG. 3 have the same labels. The top substrate electrode pattern in FIG. 5 is the same as shown in FIG. 3; however, the connection of the electrodes to the electrode pads is different. On the left side of FIG. 5, adjacent pairs of trigger electrodes are connected to a common trigger electrode pad T' while adjacent pairs of control electrodes C are connected to a common control electrode pad C'. Thus, the number of trigger electrode pads T' is reduced by half while the number of control electrode pads C' are reduced by approximately half. As will be explained below, pairs of the sustainer electrodes Y and Z are electrically connected to associated sustainer electrode pads Y' and Z', or Y" and Z", respectively, on the right side of FIG. 5, to control the discharge. Similar to the PDP shown in FIGS. 3 and 4, the reduction in the number of trigger and control electrode pads, T' and C' again permits a significant reduction in the number of electrical connections and associated driver circuitry from prior art display panels. Therefore, the present invention contemplates a significant reduction in the cost of fabrication a plasma display panel 10.

Figure 6:
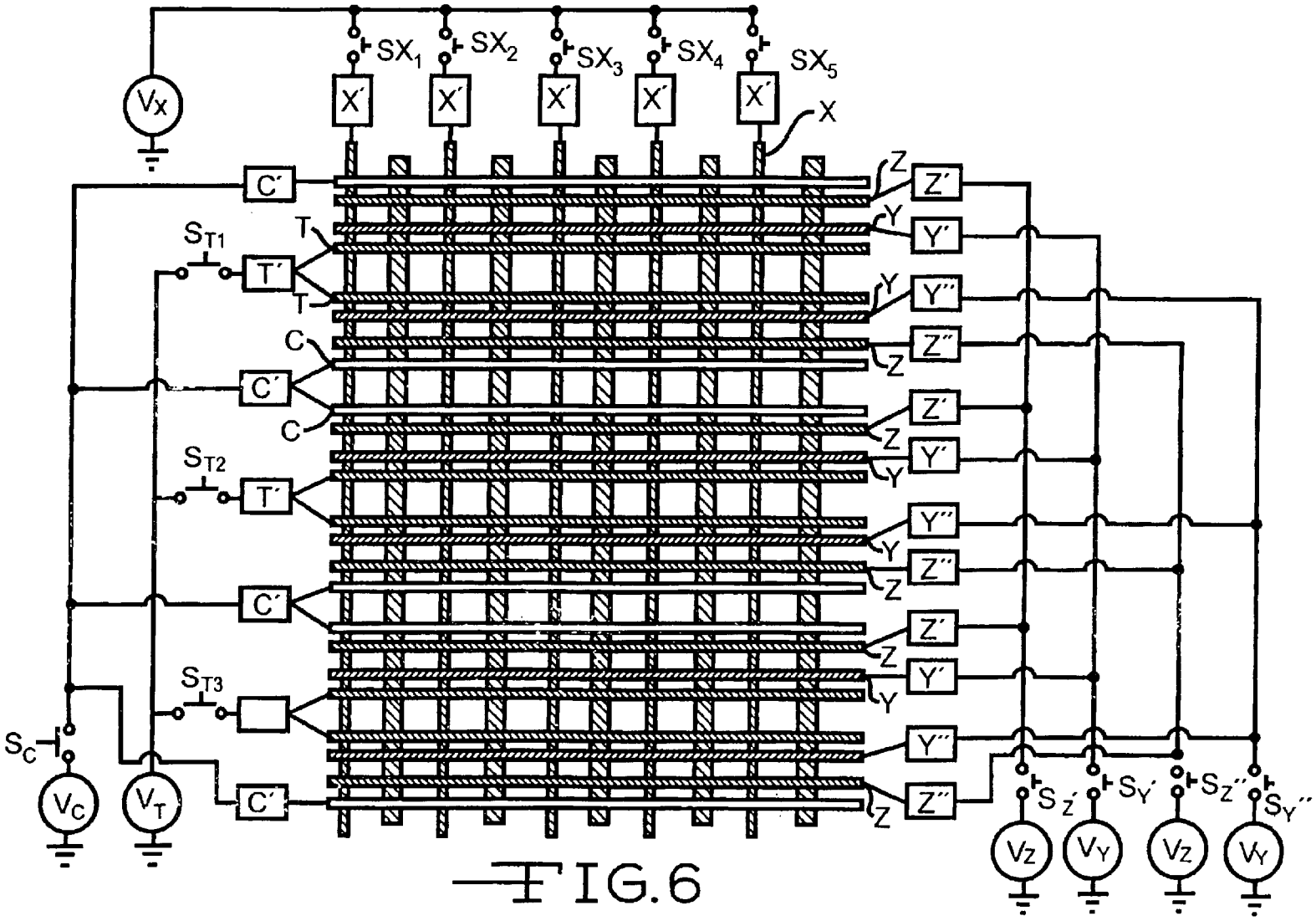
FIG. 6 is a plan view of the electrodes shown in FIG. 5 connected to voltage supplies.

The drivers associated with the electrodes are illustrated for the alternate embodiment in the plan view of the panel 10 shown in FIG. 6. As above, the drawing of the panel in FIG. 6 has been simplified for clarity. Components shown in FIG. 6 that are similar to components shown in FIG. 4 have the same labels. As explained above, the drivers consist of a voltage supply selectively coupled to associated drivers through conventional electronic switches. While a 6×5 array is shown in FIG. 6, it will be appreciated that the invention also may be practiced on larger or smaller arrays. As shown in FIG. 6, the number of electronic switches for the trigger electrodes T has been reduced from six, as shown in FIG. 4, to three. Additionally, the number of control electrodes has been reduced from six to four.

Because of the common trigger electrode pads T', trigger voltage waveforms are applied simultaneously to adjacent pairs of trigger electrodes T during operation of the plasma display panel 10. Because the trigger voltage is applied to adjacent pairs of trigger electrodes, the adjacent pairs of sustainer electrodes are supplied by separate sustaining voltage supplies connected through four electronic switches labeled $S_{Z'}$, $S_{Y''}$, $S_{Z''}$ and $S_{Y''}$. Accordingly, both the trigger voltage and sustaining voltages must be present to establish a discharge in a particular pixel. Thus, the selective application of sustaining voltage waveforms to the sustaining electrode pairs, Y and Z cooperates with the trigger voltage to control the establishment of plasma discharges for specific pixels of the display panel 10. It will be appreciated that, while four sustaining voltage supplies are shown in FIG. 6, the invention also can be practiced with one voltage supply $V_Z$ supplying both Z electrode electronic switches $S_{Z'}$ and $S_Y$" and one voltage supply $V_Y$ supplying both Y electrode electronic switches $S_{Y'}$ and $S_{Y''}$ (not shown).

The present invention also contemplates a more efficient operation of the display panel 10. The operation of the PDP 10 will now be described in view of the voltage waveforms illustrated in FIG. 7. The same voltage waveforms are used for both circuit embodiments shown in FIGS. 4 and 6. As described above, the voltage supplies generate voltage waveforms having the shapes shown while the electronic switches are selectively closed to apply the waveforms to the associated electrodes.

Figure 7:
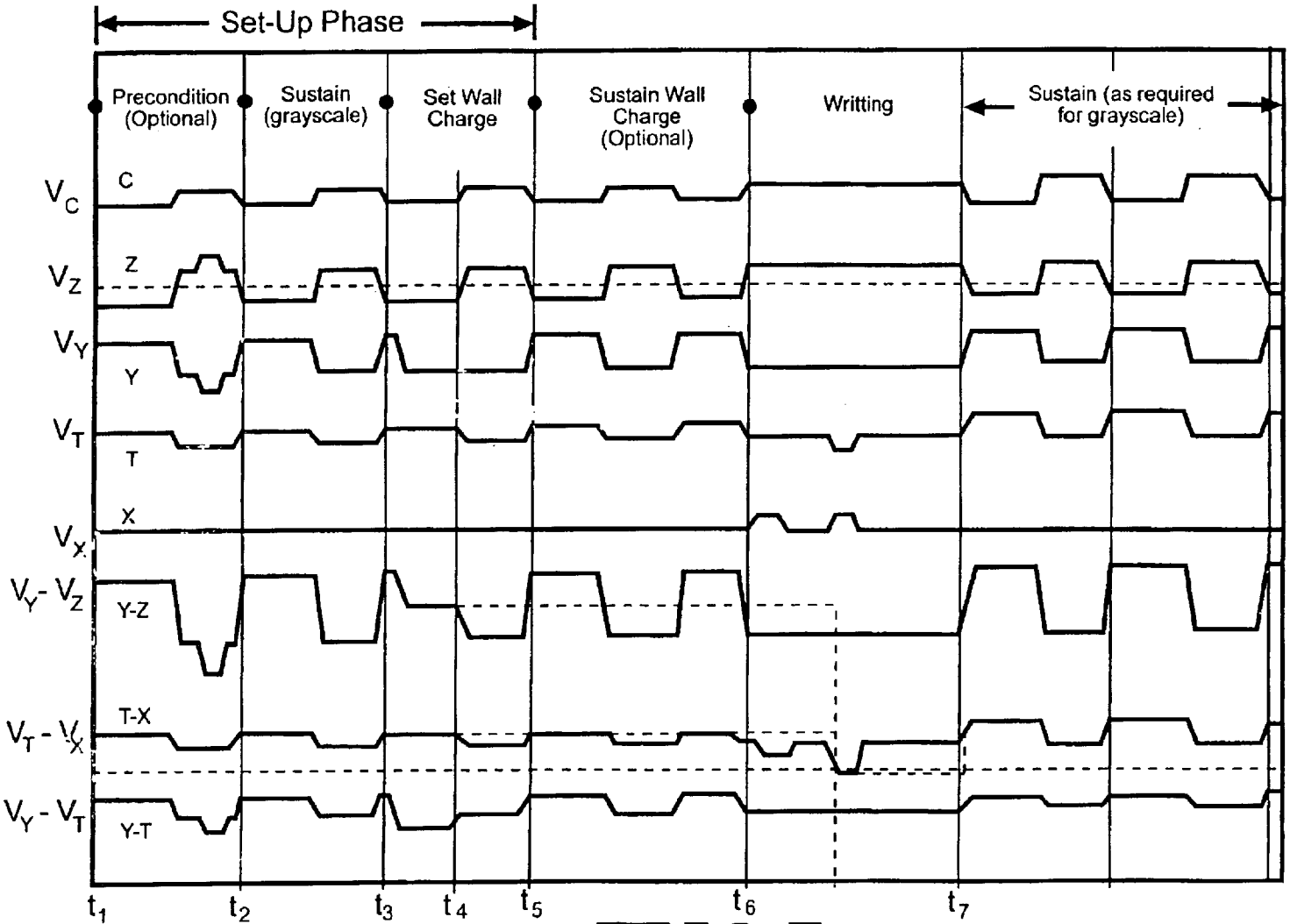
FIG. 7 illustrates the voltages applied to the electrodes in FIGS. 4 and 6 as a function of time to initiate and sustain a display upon the plasma display panel.

Initially, the plasma display panel 10 is preconditioned between $t_1$ and $t_2$. Preconditioning involves applying voltage waveforms of opposite polarities to the sustaining electrodes Y and Z and a negative going voltage to the trigger electrodes T. As a result, all wall charges are removed from the sides of the microgrooves 32. The preconditioning stage is used upon start up or when it is desired to totally clear the display panel 10, as when initiating a new display. The preconditioned state can be sustained by applying alternating voltages to the sustaining electrodes Y and Z as shown by the curves labeled $V_Y$ and $V_Z$ between $t_2$ and $t_3$. While only one cycle of alternating sustaining voltages are illustrated in FIG. 7, the wall charge can be maintained for a longer time period by continuing the application of alternating voltages. The preconditioning and sustaining is often referred to as a "bulk erase" since the entire display panel 10 is cleared.

Figure 8:
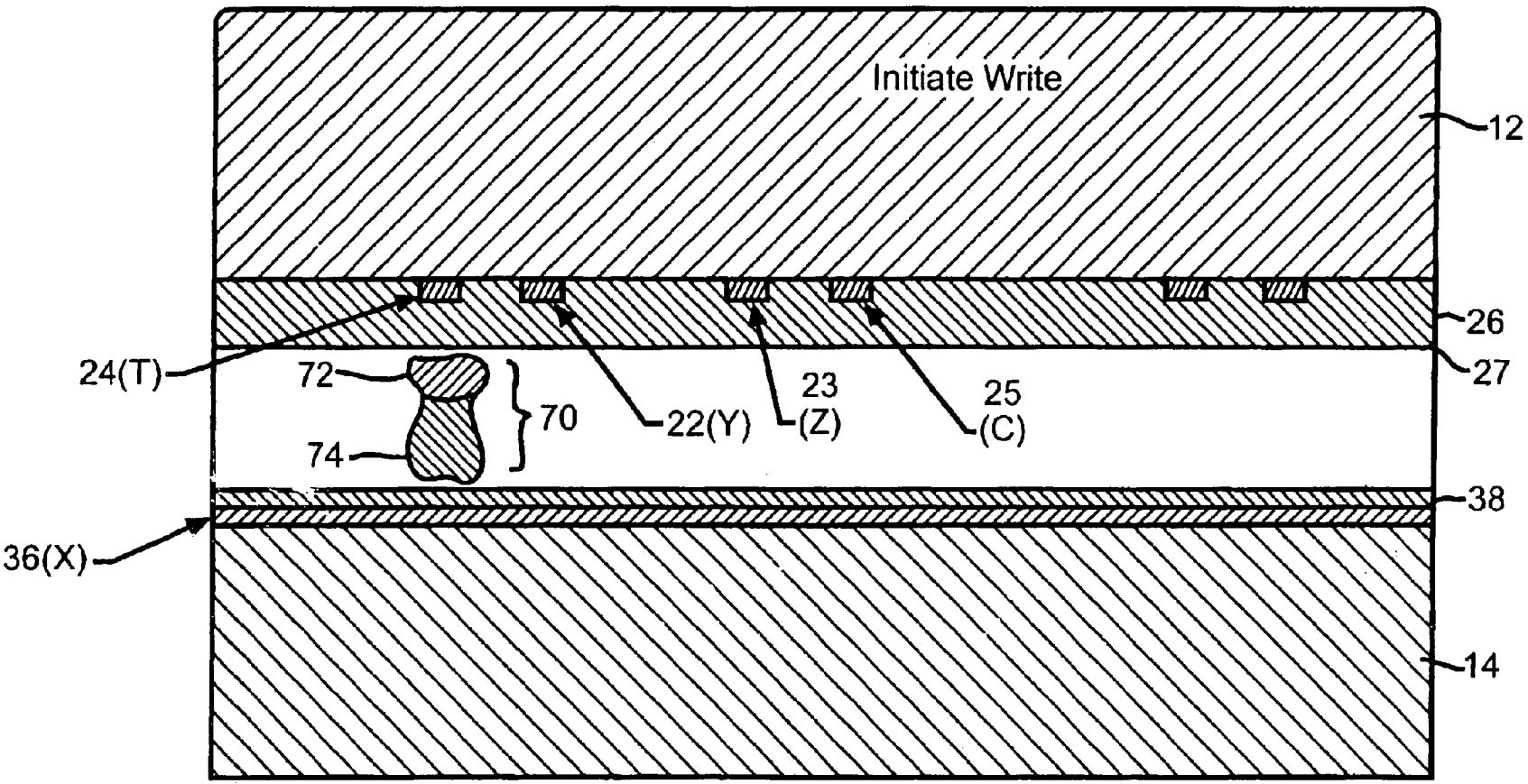
FIG. 8 is sectional view of the plasma display panel in FIG. 1 taken along line 2—2 illustrating operation of the panel during an initiate write phase.
Figure 9:
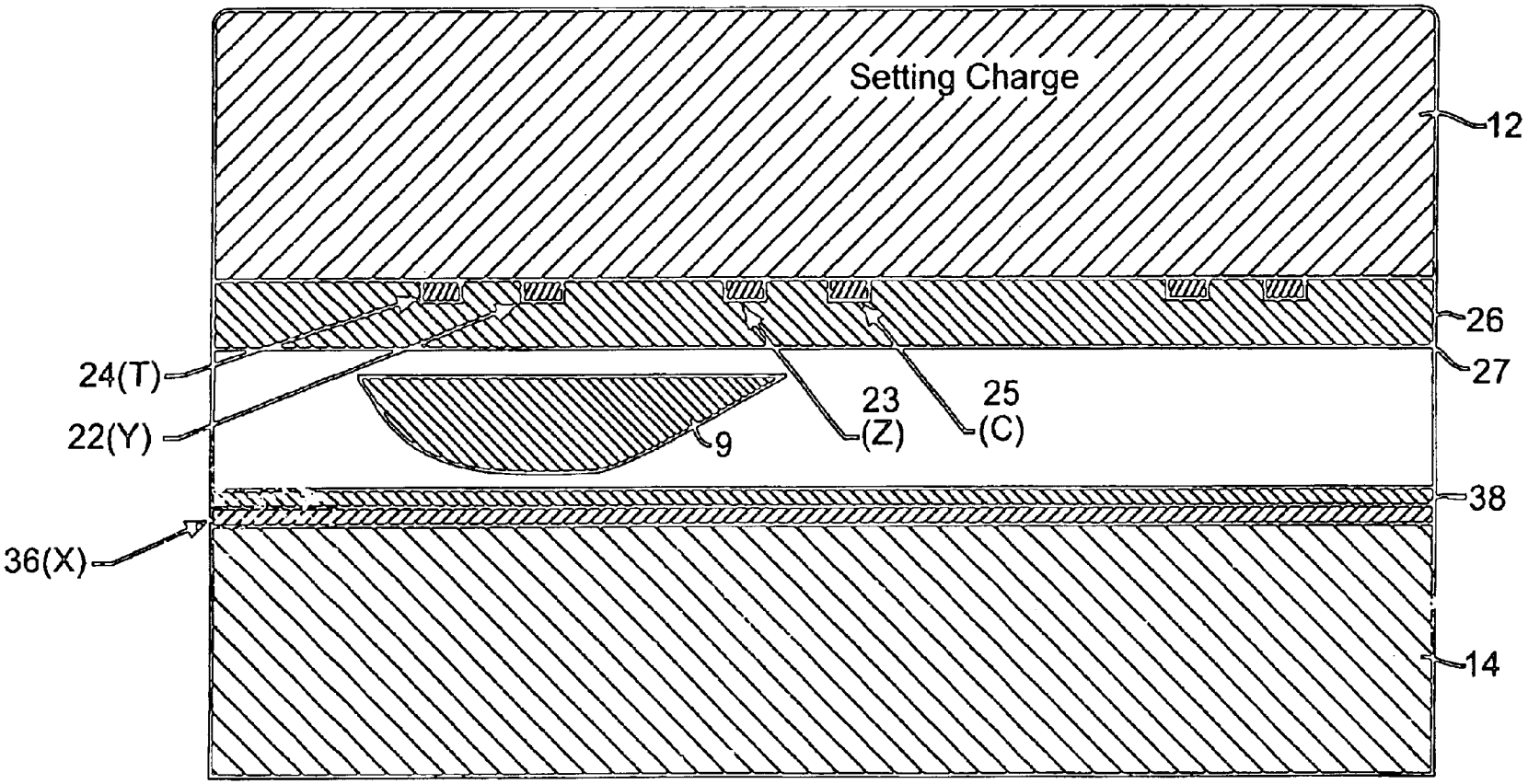
FIG. 9 is sectional view of the plasma display panel in FIG. 1 taken along line 2—2 illustrating operation of the panel during a setting charge phase.

To prepare the panel 10 for writing, the first and second sustainer voltages both go negative from $t_3$ to $t_4$ while the trigger voltage goes positive. As shown in FIG. 8, these voltages establish a brief plasma discharge 70 that extends transversely across the microgroove 32 between the trigger electrode T on the top substrate 12 and the opposite address electrode X on the bottom substrate 14. The plasma discharge 70 includes a cathode fall region 72 and a plasma plume 74. The plasma discharge 70 causes wall charges 76 to accumulate upon the adjacent sidewalls of the microgroove 32 containing the discharge 70. When the sustainer electrode voltages resume alternating at $t_4$, the plasma discharge 70 is extinguished; however, the wall charges 76 remain, as illustrated in FIG. 9. The wall charges are shown as dashed lines in the voltage waveforms labeled $V_Y$–$V_Z$ and $V_T$–$V_X$ in the lower portion of FIG. 7. The associated portion of the panel 10 is now prepared for writing. Accordingly, the portion of the voltage curves between $t_1$ and $t_5$ is often referred to as the "set-up" phase. The wall charge can be maintained by alternating the sustaining voltages $V_Y$ and $V_Z$, as shown in FIG. 7 from $t_5$ to $t_6$.

Figure 10:
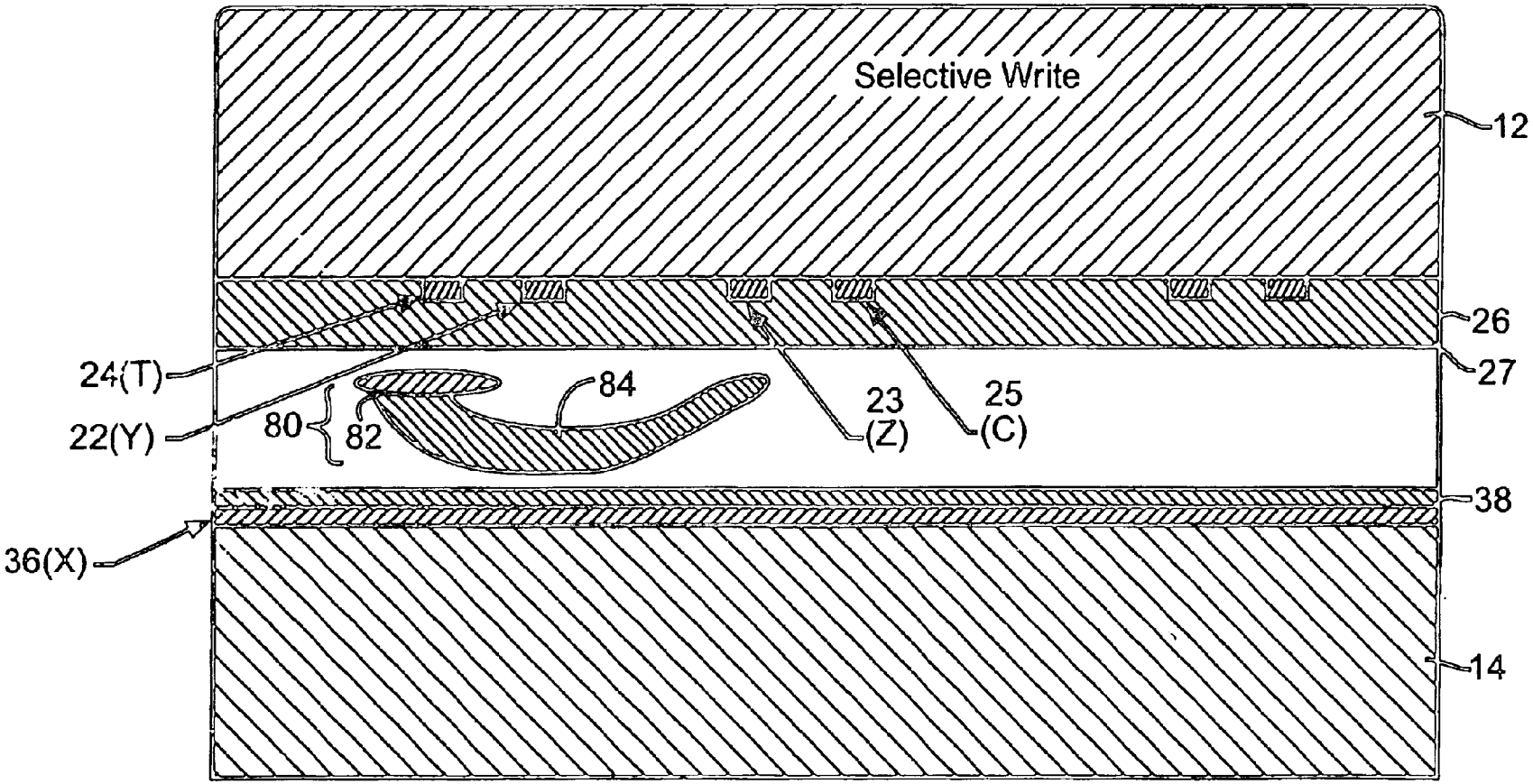
FIG. 10 is sectional view of the plasma display panel in FIG. 1 taken along line 2—2 illustrating operation of the panel during a sustaining phase.
Figure 11:
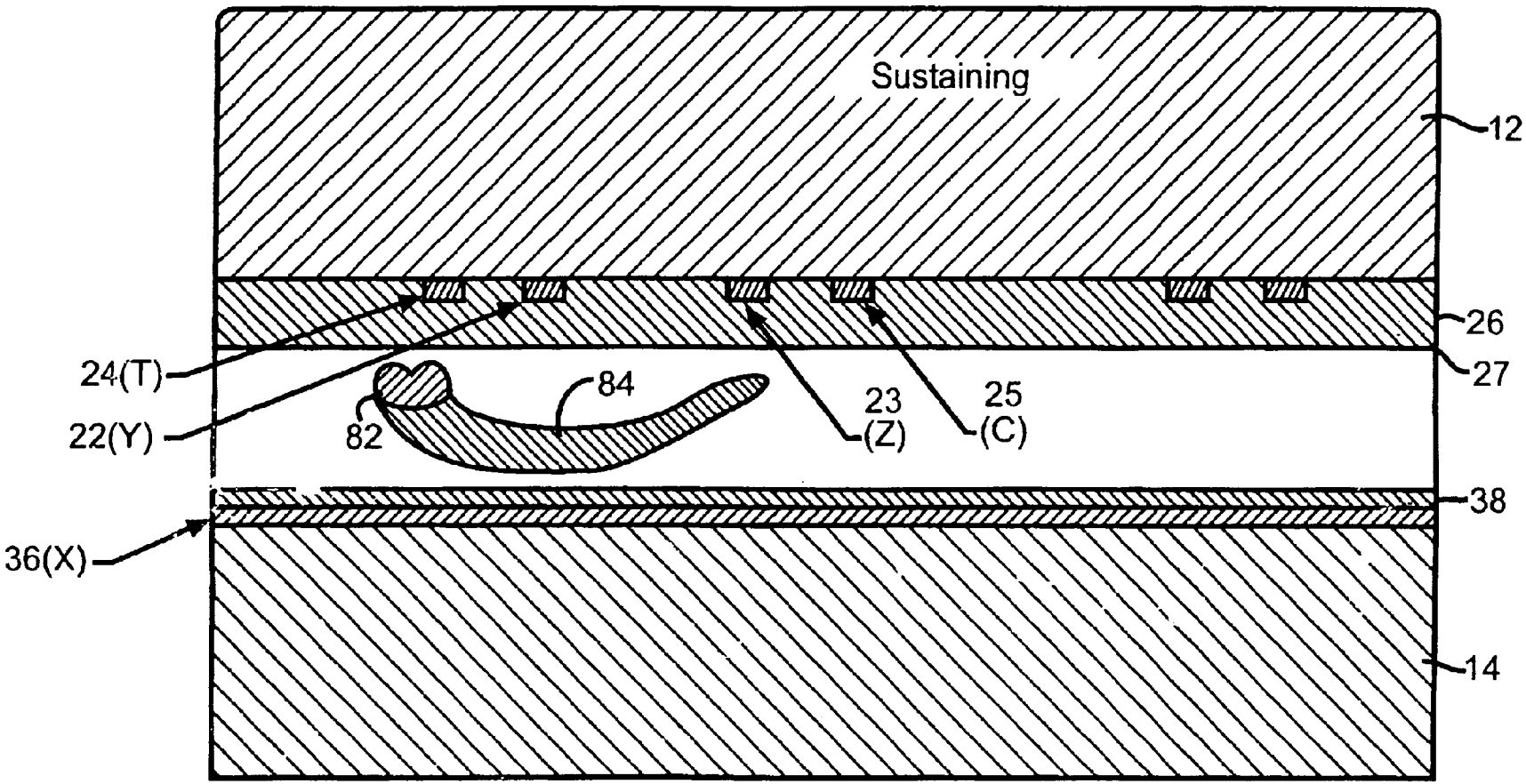
FIG. 11 is sectional view of the plasma display panel in FIG. 1 taken along line 2—2 illustrating operation of the panel during a selective write phase phase.

At $t_6$, the actual writing to illuminate a selected pixel begins. The voltage waveform applied to the address electrode X goes positive while the first and second sustainer voltages go negative and positive, respectively. As a result, a plasma discharge plume 80 is reestablished in the microgroove 32. As shown in FIG. 10, the plume 80 arcs from the trigger and first sustainer electrodes T and Y laterally within the microgroove 32 to the second sustainer electrode Z. The plume 80 consists of ionized gas and includes positively charged ions and negatively charged electrons which excites the phosphor 38 deposited with the microgroove 32. The excited phosphor 38 emits visible light. At $t_7$, the sustaining voltages resume alternating to sustain the plasma plume 80 and thereby the emission of light from the associated pixel, as illustrated in FIG. 11.

The inventors have found that, with the plasma display panels described above, a relatively low trigger voltage of less than 100 volts can initiate a plasma discharge 80 for a relatively high sustaining voltage of 280 to 380 volts, which is significantly greater than typical sustaining voltages of 180 to 200 volts as are known in the art. The higher sustaining voltage drives the plasma discharge 80 deeper into the channel, as shown in FIGS. 10 and 11. The deeper penetration of the discharge 80 into the microgroove 32 results in additional phosphor 38 being excited, which, in turn, yields a brighter display. Additionally, the higher sustaining voltage improve the efficiency of the panel 10 by reducing the amount of current required to power the display.

As shown in FIGS. 4 and 6, the invention contemplates separate trigger and sustaining voltage supplies $V_T$, $V_Y$, and $V_Z$. In prior art panels the same voltage supply was typically utilized to supply both the trigger and sustaining voltages. This not only increased the complexity of the switching circuitry, but also limited the magnitude of the sustaining voltages. Accordingly, provision of a separate trigger voltage supply $V_T$ allows increasing the sustaining voltage magnitudes as described above.

Figure 12:
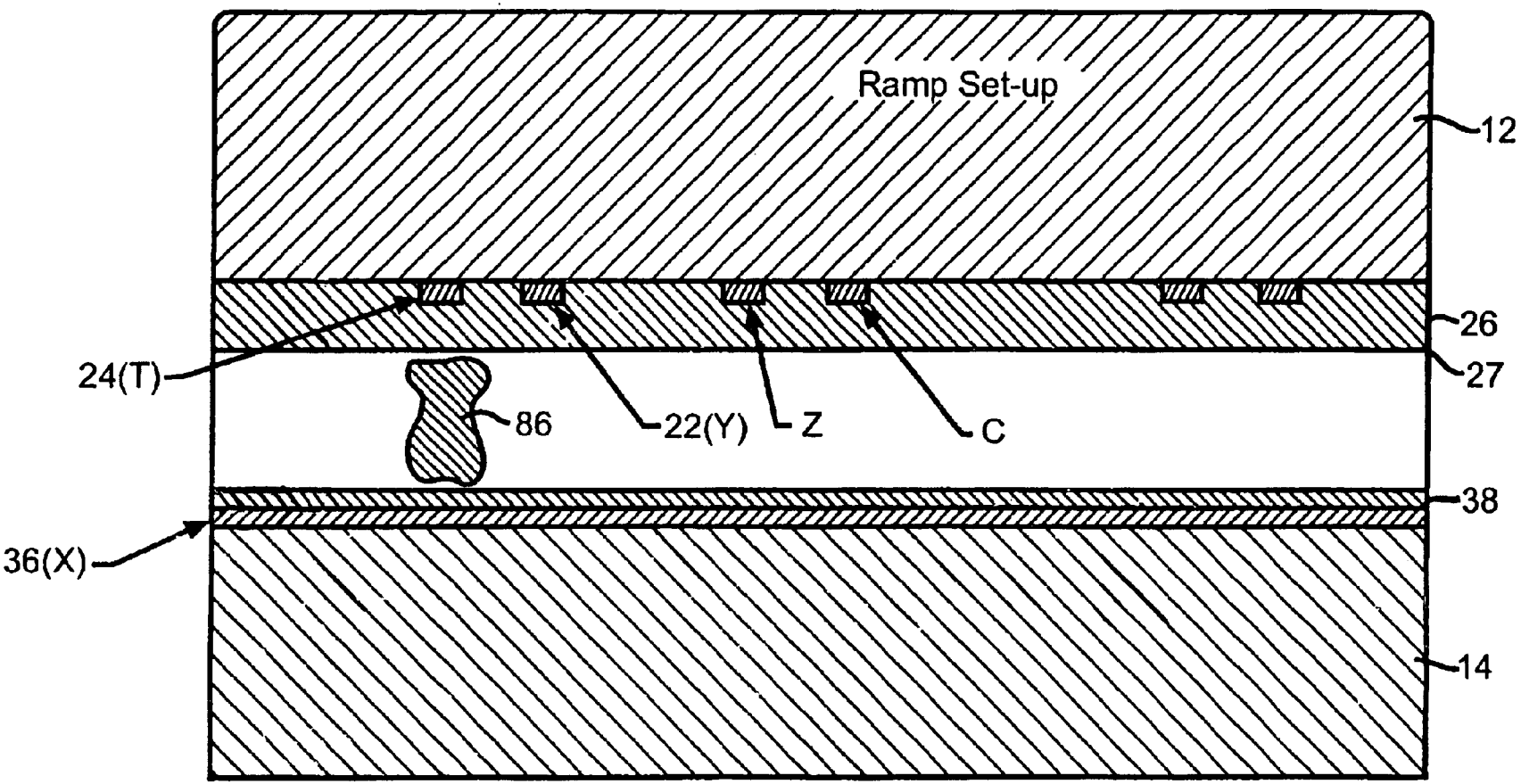
FIG. 12 is sectional view of the plasma display panel in FIG. 1 taken along line 2—2 illustrating operation of the panel during an initiate write phase utilizing a ramped voltage.

As described above, the initial portion of the set-up erases the cells in the panel. Similar sustaining and trigger voltages can be applied to selected electrodes to erase a particular cell. However, the erasing typically generates a brief low level illumination of the cell. The low level illumination can reduce the contrast of the image appearing on the panel 10. Accordingly, the invention also contemplates applying ramped sustaining voltages (not shown) to eliminate the illumination during the erase operation. The ramped voltages result in a localized wall charge 86, as shown in FIG. 12.

The invention further contemplates applying control voltage waveforms to the panel 10. Such control voltage waveforms are generated by the control voltage supply $V_C$ and applied through a single conventional electronic switch $S_C$, as illustrated by the circuit diagrams shown in FIGS. 4 and 6. The associated control voltage waveforms are shown as the top curve in FIG. 7. The control voltage waveforms supplement the sustainer voltages to assure that the plasma plume 80 is urged deeply into the microgroove 32 and to otherwise control the shape of the plume 80.

Figure 13:
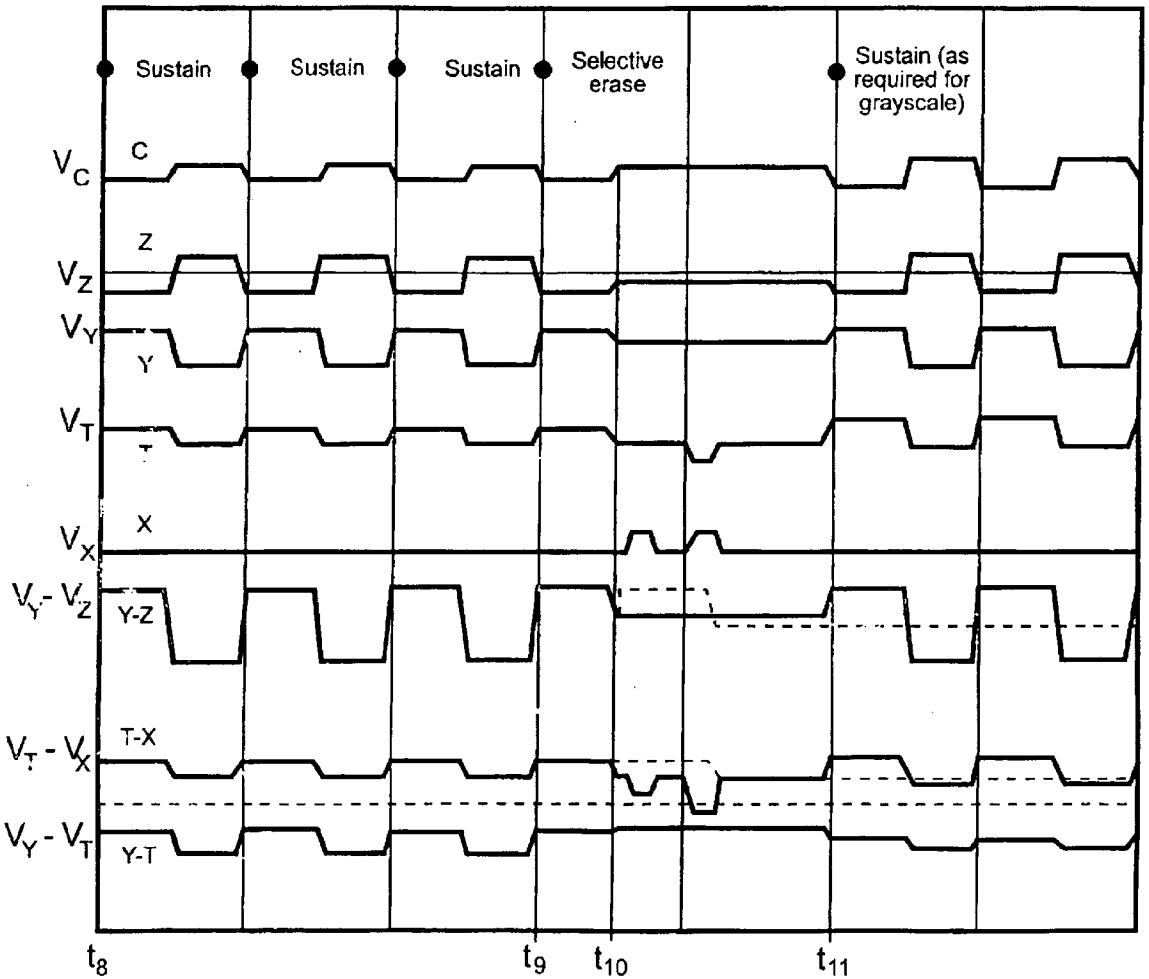
FIG. 13 illustrates the voltages applied to the electrodes in FIGS. 4 and 6 as a function of time to erase the plasma discharge panel.

The present invention also contemplates a method for selectively erasing selected pixels on a plasma display panel. The voltages applied to the panel electrodes to erase a pixel are illustrated in FIG. 13. In FIG. 13, it is assumed that a plasma discharge exists and is being sustained from $t_8$ through $t_9$. The times shown along the horizontal axis in the figure continue the times shown in preceding FIG. 7. At $t_9$, a selective erase is initiated. At $t_{10}$, the voltages on the sustaining electrodes, Y and Z, are reduced to zero and held at zero while pulses are applied to the trigger and address electrodes, T and X, for the specific pixel. The trigger and electrode pulses cooperate with the reduced sustainer electrode voltages to erase the illuminated pixel. Then, at $t_{11}$, the voltages are returned to their normal sustaining values. The erased cell retains the wall charges necessary to reestablish a plasma discharge; however, the voltages applied to the electrodes are insufficient to trigger another discharge. It would be necessary for the voltages applied to the sustaining electrodes, Y and Z, to be held at opposite voltages while pulses are applied to the corresponding trigger and address electrodes, T and X, as shown from $t_6$ to $t_7$ in FIG. 7, to restart the plasma discharge. Thus, the erase step leaves the cell in condition for re-initiation of the discharge.

It will be noted that the magnitude of the voltages applied to the trigger and control electrodes, T and C, varies in both FIGS. 7 and 13. The variation represents the capability to adjust the shape and depth of the discharge that is included as part of the invention.

Figure 14:
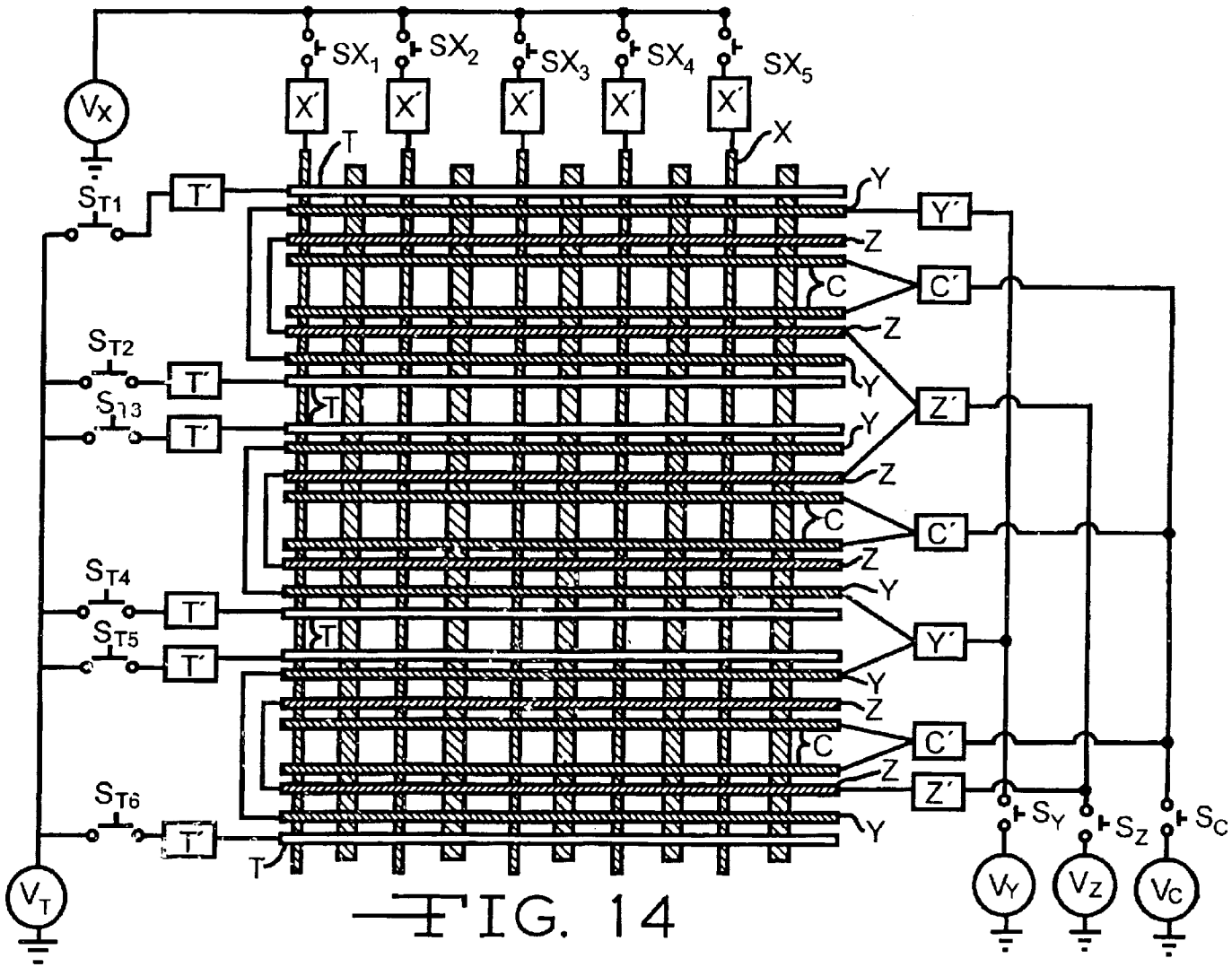
FIG. 14 is a plan view of another alternate embodiment of the plasma display panel shown in FIGS. 3 and 4.

The present invention further contemplates an alternate circuit embodiment of the PDP illustrated in FIGS. 3 and 4. The alternate embodiment is shown in FIG. 14 where the sustaining electrodes Y and Z in adjacent electrode groups are connected together and supplied by a single contact pad Y' and Z'. While the electrodes are in a different sequence from top to bottom of FIG. 14 than shown in FIGS. 3 and 4, it will be noted that the adjacent groups of sustainer electrodes Y and Z, trigger electrode T and control electrode C are arranged as mirror images of one another. Additionally, it is contemplated that the circuit connections shown in FIG.

14 also can be applied to the PDP electrode orientation shown in FIG. 3.

The top Y electrode in FIG. 14 has a right end 13 connected through the electronic switch $S_Y$ to sustaining voltage supply labeled $V_Y$ and a left end connected to the left end of the Y electrode in the second electrode group from the top of the figure. The top Z electrode has a left end connected to the left end of the Z electrode in the second group from the top of the figure. The Z electrode in the second group also has a right end connected through the electronic switch $S_Z$ to the sustaining voltage supply labeled $V_Z$. The connections shown to the sustaining voltage supplies $V_Z$ and $V_Y$ not only reduce the number of contact pads and simplify the driver circuits but also compensate for voltage drops in the sustaining electrodes Z and Y. Because the voltage is applied to opposite ends of the combined pairs of Z and Y sustaining electrodes, the voltage difference between each pair of sustaining electrodes and across the micro-void remains the same even if the there is a voltage drop along the electrode. The control electrode pads C' have been moved to the right side of the panel to avoid crossing the connecting traces with the traces connecting the Y and Z electrode ends.

The operation of the PDP shown in FIG. 14 is the same as described above.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope. Thus, the driver circuitry for the sustaining and control electrodes illustrated in FIGS. 4, 6 and 13 also can be applied to the prior art electrode structure shown in FIG. 2 (not shown).

What is claimed is:

1. A plasma flat-panel display comprising:

a first transparent substrate comprising:

an array of pairs of parallel sustainer electrodes deposited upon said first substrate, each of said pairs of sustainer electrodes including a first sustainer electrode and a second sustainer electrode, each of said first sustainer electrodes being connected to corresponding first sustainer electrode pads, said sustainer electrode pads being adapted to be connected into at least one group, said group connected to a first sustainer voltage waveform supply;

each of said second sustainer electrodes are connected to corresponding second sustainer electrode pads, said sustainer electrode pads being adapted to be connected into at least one group, said group connected to a second sustainer voltage waveform supply of opposite phase from the first;

auxiliary electrodes deposited upon said first substrate parallel to and corresponding to each of said pairs of sustainer electrodes, at least a first auxiliary electrode being adjacent to a first sustainer electrode in each pair of sustainer electrodes with at least one of said auxiliary electrodes adjacent to each first sustainer electrode being connected to an associated auxiliary electrode pad, said auxiliary electrode pads being adapted to be connected to a multiplicity of individually controllable first control voltage waveform supplies;

a dielectric layer formed from a dielectric material covering said sustainer and auxiliary electrodes;

a further protection layer formed from an electron emissive material covering said dielectric;

a second substrate which is hermetically sealed to said first substrate comprising:

an array of micro-voids formed in the surface of said second substrate which is adjacent to said first substrate;

a plurality of address electrodes incorporated within said second substrate, each of said address electrodes orthogonal to said sustain electrodes and corresponding to each of said micro-voids, said micro-voids cooperating with said first substrate to define a plurality of sub-pixels, each of said sub-pixels defining a controlled discharge volume at the intersection of said address electrodes and sustainer electrode pairs with associated auxiliary electrodes with each of said address electrodes being connected to a corresponding address electrode pad, said address electrode pads being adapted to be connected to an individually controllable address voltage waveform supply substantially in phase with said first sustainer voltage waveform supply but at a lower voltage;

a phosphor material deposited within each micro-void and associated with said address electrodes; and a gas filling said micro-voids.

2. A plasma display according to claim 1 wherein a second of said auxiliary electrodes adjacent to each second sustain electrode is connected to an associated auxiliary electrode pad, said second auxiliary electrode pads being adapted to be connected in common into at least one group to a second control voltage waveform supply operated substantially at opposite phase to said first control voltage waveform supplies.

3. A plasma flat-panel display according to claim 1 wherein said first and second sustainer voltage waveform supplies apply voltage waveforms to said sustainer electrodes to sustain a plasma discharge sequence between said first and second sustaining electrodes, the discharge path being controlled in position and shape by the auxiliary voltage waveforms, whereby the illumination of the associated sub-pixel may be enhanced.

4. A plasma display according to claim 3 wherein said waveform supplies cooperate to apply voltage waveforms which eliminate any wall charge on the dielectric surfaces associated with all electrodes in a set-up period, said address voltage waveform supplies cooperate with said first auxiliary voltage waveform supplies to apply voltages which selectively initiate a discharge in the controlled discharge volume between said first sustain electrode and second sustain electrode and allow collection of charge on the dielectric surfaces associated with first and second sustain electrodes in an amount substantially identical to that of normal sustaining in the controlled discharge volumes corresponding to selected sub-pixels in an addressing period, and said voltage waveform supplies cooperate to create a predetermined number of sequential sustain discharges in the controlled discharge volume between said first and second sustain electrodes in sub-pixels which have stored charges on said associated dielectric surfaces of sustain electrodes in a sustain period.

5. A plasma flat-display panel according to claim 3 wherein said sustainer voltage waveforms are greater than 250 volts and further wherein said trigger voltage waveforms are less than 100 volts.

6. A plasma flat-display according to claim 4 wherein said sustainer voltage waveforms are in the range of 280 to 380 volts.

7. A plasma flat-display panel according to claim 1 wherein said auxiliary electrodes are positioned between said first and second sustain electrodes.

8. A plasma flat-display panel according to claim 1 wherein said auxiliary electrodes are positioned outside of said first and second sustain electrodes.

9. A plasma flat-display panel according to claim 1 wherein said sustain electrodes are of the same width, but different from the widths of said auxiliary electrodes.

10. A plasma flat-display panel according to claim 8 wherein said first and second sustain electrode pairs are alternately mirrored along the array of pairs such that a pattern of first-second-second-first sustain electrodes is formed and repeated throughout the array.

11. A plasma flat-panel display according to claim 10 wherein said auxiliary electrodes are commonly connected to a pad which is shared between two neighboring auxiliary electrodes, thus reducing the number of pads by half and corresponding auxiliary waveform voltage supplies by half.

12. A plasma flat-display panel according to claim 10 wherein said first sustain electrodes are commonly connected to a pad which is shared between two neighboring first sustain electrodes, and second sustain electrodes are connected to a pad which is shared between two neighboring second sustain electrodes, thus reducing the number of pads by half.

13. A plasma flat-panel display according to claim 2 wherein said first and second sustainer voltage waveform supplies apply voltage waveforms to said sustainer electrodes to sustain a plasma discharge sequence between said first and second sustaining electrodes, the discharge path being controlled in position and shape by the auxiliary voltage waveforms, whereby the illumination of the associated sub-pixel may be enhanced.

14. A plasma display according to claim 13 wherein said waveform supplies cooperate to apply voltage waveforms which eliminate any wall charge on the dielectric surfaces associated with all electrodes in a set-up period, said address voltage waveform supplies cooperate with said first auxiliary voltage waveform supplies to apply voltages which selectively initiate a discharge in the controlled discharge volume between said first sustain electrode and second sustain electrode and allow collection of charge on the dielectric surfaces associated with first and second sustain electrodes in an amount substantially identical to that of normal sustaining in the controlled discharge volumes corresponding to selected sub-pixels in an addressing period, and said voltage waveform supplies cooperate to create a predetermined number of sequential sustain discharges in the controlled discharge volume between said first and second sustain electrodes in sub-pixels which have stored charges on said associated dielectric surfaces of sustain electrodes in a sustain period.

15. A plasma flat-panel display comprising:

a first transparent substrate;

a first pair of parallel sustainer electrodes deposited upon said first substrate, said first pair of sustainer electrodes including a first sustainer electrode and a second sustainer electrode;

at least one auxiliary electrode deposited upon said first substrate parallel to said first pair of sustainer electrodes, one of said auxiliary electrodes being adjacent to said first sustainer electrode in said first pair of sustainer electrodes;

a second pair of parallel sustainer electrodes deposited upon said first substrate parallel to said auxiliary electrodes, said second pair of sustainer electrodes including a first sustainer electrode and a second sustainer electrode, said sustainer electrode pair being oriented upon said first substrate as a mirror image of said first sustainer electrode pair such that said first sustainer electrode in said second pair of sustainer electrodes is adjacent to said other of said auxiliary electrodes;

a single common first sustainer electrode pad electrically connected to said first sustainer electrode in said first sustainer electrode pair and said first sustainer electrode in said second sustainer electrode pair, said first sustainer electrode pad adapted to be connected to a first sustainer voltage waveform supply whereby a single supply provides a first sustainer voltage waveform to both of said first sustainer electrodes;

a dielectric layer formed from a dielectric material covering said sustainer and trigger electrodes;

a protection layer formed covering said dielectric layer a second substrate which is hermetically sealed to said first substrate, said second substrate having a plurality of micro-voids formed in a surface thereof which is adjacent to said first substrate, said micro-voids cooperating with said first substrate to define a plurality of sub-pixels;

a gas filling said micro-voids;

a phosphor material deposited within each micro-void; and a plurality of address electrodes incorporated within said second substrate, each of said address electrodes corresponding to one of said sub-pixels.

16. A plasma flat-panel display comprising:

a first transparent substrate;

a first pair of parallel sustainer electrodes deposited upon said first substrate, said first pair of sustainer electrodes including a first sustainer electrode and a second sustainer electrode;

at least one auxiliary electrode deposited upon said first substrate parallel to said first pair of sustainer electrodes, one of said auxiliary electrodes being adjacent to said first sustainer electrode in said first pair of sustainer electrodes;

a second pair of parallel sustainer electrodes deposited upon said first substrate parallel to said auxiliary electrodes, said second pair of sustainer electrodes including a first sustainer electrode and a second sustainer electrode, said sustainer electrode pair being oriented upon said first substrate as a mirror image of said first sustainer electrode pair such that said first sustainer electrode in said second pair of sustainer electrodes is adjacent to said other of said auxiliary electrodes;

a single common first sustainer electrode pad electrically connected to one end of said first sustainer electrode in said first sustainer electrode pair and said other end of first sustainer electrode being connected to a corresponding end of said first sustainer electrode in said second sustainer electrode pair;

a single common second sustainer electrode pad electrically connected to one end of said second sustainer electrode in said second sustainer electrode pair and said other end of second sustainer electrode being connected to a corresponding end of said second sustainer electrode in said first sustainer electrode pair;

a dielectric layer formed from a dielectric material covering said sustainer and trigger electrodes;

a protection layer formed covering said dielectric layer a second substrate which is hermetically sealed to said first substrate, said second substrate having a plurality of micro-voids formed in a surface thereof which is adjacent to said first substrate, said micro-voids cooperating with said first substrate to define a plurality of sub-pixels;

a gas filling said micro-voids;

a phosphor material deposited within each micro-void; and a plurality of address electrodes incorporated within said second substrate, each of said address electrodes corresponding to one of said sub-pixels.

17. A plasma flat-display panel comprising:

a first transparent substrate comprising:

an array of pairs of parallel sustainer electrodes deposited upon said first substrate, each of said pairs of sustainer electrodes including a first sustainer electrode and a second sustainer electrode, said sustainer electrodes having the same widths with first and second sustainer electrode pairs being alternately mirrored along the array of pairs such that a pattern of first-second-second-first sustain electrodes is formed and repeated throughout the array;

a pair of auxiliary electrodes having deposited upon said first substrate parallel to and corresponding to each of said pairs of sustainer electrodes, at least a first auxiliary electrode being adjacent to a first sustainer electrode in each pair of sustainer electrodes, said auxiliary electrodes having widths that are different from widths of said sustainer electrodes;

a dielectric layer formed from a dielectric material covering said sustainer and auxiliary electrodes;

a further protection layer formed from an electron emissive material covering said dielectric;

a second substrate which is hermetically sealed to said first substrate comprising:

an array of micro-voids formed in the surface of said second substrate which is adjacent to said first substrate;

a plurality of address electrodes incorporated within said second substrate, each of said address electrodes orthogonal to said sustain electrodes and corresponding to each of said micro-voids, said micro-voids cooperating with said first substrate to define a plurality of sub-pixels, each of said sub-pixels defining a controlled discharge volume at the intersection of said address electrodes and sustainer electrode pairs with associated auxiliary electrodes;

a phosphor material deposited within each micro-void and associated with said address electrodes; and a gas filling said micro-voids.

18. A plasma flat-panel display according to claim 17 wherein said auxiliary electrodes are commonly connected to a pad which is shared between two neighboring auxiliary electrodes, thus reducing the number of pads by half and corresponding auxiliary waveform voltage supplies by half.

19. A plasma flat-display panel according to claim 17 wherein said first sustain electrodes are commonly connected to a pad which is shared between two neighboring first sustain electrodes, and second sustain electrodes are connected to a pad which is shared between two neighboring second sustain electrodes, thus reducing the number of pads by half.

* * * * *